US006616809B2

(12) United States Patent
Conrad et al.

(10) Patent No.: US 6,616,809 B2
(45) Date of Patent: Sep. 9, 2003

(54) PROCESS AND DEVICE FOR PRODUCING PAPER REELS

(75) Inventors: Hans-Rolf Conrad, Dormagen (DE); Dirk Cramer, Duisburg (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/911,547

(22) Filed: Jul. 25, 2001

(65) Prior Publication Data

US 2002/0060001 A1 May 23, 2002

(30) Foreign Application Priority Data

Aug. 10, 2000 (DE) ..... 100 39 040

(51) Int. Cl.[7] ..... D21G 1/00; D21F 7/02

(52) U.S. Cl. ..... 162/283; 162/194; 162/193; 242/525.1; 242/530.4; 242/531; 242/533.2; 242/542; 242/542.3

(58) Field of Search ..... 162/193, 194, 162/286, 283, 284, 285, 205; 242/525.1, 530.1, 530.3, 530.4, 531.1, 531, 533.2, 542, 542.3; 100/38; 700/129

(56) References Cited

U.S. PATENT DOCUMENTS

| | | | | | |
|---|---|---|---|---|---|
| 999,375 | A | * | 8/1911 | Liebeck | 162/283 |
| 3,841,578 | A | * | 10/1974 | Dorfel | 242/533.2 |
| 3,869,095 | A | * | 3/1975 | Diltz | 242/531 |
| 4,183,474 | A | * | 1/1980 | Schonmeier | 242/533.2 |
| 4,508,279 | A | | 4/1985 | Tokumo et al. | |
| 4,508,283 | A | * | 4/1985 | Beisswanger | 242/533.2 |
| 4,763,822 | A | | 8/1988 | Mohrsen | |
| 5,137,225 | A | * | 8/1992 | Biagiotti | 242/533.2 |
| 5,158,648 | A | | 10/1992 | Weldon | |
| 5,234,549 | A | | 8/1993 | Weldon | |
| 5,651,863 | A | * | 7/1997 | Van Haag | 162/207 |
| 5,771,793 | A | | 6/1998 | Kayser | |
| 5,943,787 | A | | 8/1999 | Kilpipä et al. | |
| 6,076,281 | A | | 6/2000 | Kilpiä et al. | |

FOREIGN PATENT DOCUMENTS

| | | |
|---|---|---|
| CA | 2179493 | 5/1996 |
| DE | 4412625 | 10/1995 |
| DE | 4437533 | 4/1996 |
| DE | 19519011 | 5/1996 |
| DE | 19720174 | 11/1998 |
| EP | 0744492 | 11/1996 |

* cited by examiner

*Primary Examiner*—Steven P. Griffin
*Assistant Examiner*—Eric Hug
(74) *Attorney, Agent, or Firm*—Greenblum & Bernstein, P.L.C.

(57) ABSTRACT

Process and apparatus for producing paper reels from a paper web. The process includes calendering the paper web, longitudinally cutting the paper web into partial webs, and winding the partial webs into paper reels. The calendering, longitudinal cutting, and winding occur on-line and without intermediate winding. The apparatus includes a paper machine, a calender, a longitudinal cutting device, and a reel winding device. The paper machine, the calender, the longitudinal cutting device, and the reel winding device are successively arranged in a web run direction.

26 Claims, 3 Drawing Sheets

PROCESS AND DEVICE FOR PRODUCING PAPER REELS

CROSS-REFERENCE TO RELATED APPLICATIONS

The present application claims priority under 35 U.S.C. §119 of German Patent Application No. 100 39 040.4, filed on Aug. 10, 2000, the disclosure of which is expressly incorporated by reference herein in its entirety.

BACKGROUND OF THE INVENTION

1. Field of the Invention

The invention relates to a process for producing paper reels from a paper web in which the paper web is calendered and cut lengthwise into partial webs and the partial webs are wound into paper reels. The invention further relates to a device for producing paper reels having a paper machine, a calender, a longitudinal cutting device, and a reel winding device.

2. Discussion of Background Information

The production of paper is known per se. In the paper machine, pulp is poured onto a circulating wire through which the water can drain. At the end of the wire, the paper web being formed is transferred to a drying section that allows a base paper to be removed at the exit of the paper machine. In most cases, this base paper is wound into a jumbo reel. On the jumbo reel, the paper web is then transported to a calender and calendered. At the end of the calender, the calendered paper is wound and guided to a reel cutting and winding device. In the reel cutting and winding device, the paper web, which is generally present in a width of up to 10 m, is cut into manageable widths in the range of 0.5 to 3.8 m and wound into paper reels having a diameter in the range of 0.5 to 2.5 m. Later on, only paper reels of this type are manageable for a consumer, for example, a printer.

This process is relatively time-consuming, but has the advantage that all process steps can occur at a speed that is adapted to the respective process. However, the material web is strained by the several transitional or intermediate windings in this process.

SUMMARY OF THE INVENTION

Accordingly, the present invention simplifies the production of paper reels.

In particular, the invention provides a process of the type mentioned at the outset which also includes that the calendering, longitudinal cutting, and winding occur on-line without intermediate winding.

In other words, the paper web exiting the paper machine is immediately guided to a calender in order to calender it. From the exit of the calender, the paper web is guided to the longitudinal cutting and winding device, without intermediate winding, so that the paper reels are produced at the same speed at which the paper machine dispenses the paper web. In this way, the paper web is protected because only one single winding sequence is necessary. Moreover, because it is not necessary that the paper web be intermediately wound onto jumbo reels, considerable set-up times that are necessary for preparing the reel spools and for moving the reel spools and the jumbo reels are omitted. Finally, a large savings in apparatus, e.g., crane arrangements needed for moving the reel spools and jumbo reels, is attained.

In an exemplary embodiment, a narrow strip of the paper web can be guided into the winding device at the beginning of production and from there into a disposal device. This strip can then be extended to the width of the paper web, longitudinally cut, and the longitudinally cut partial webs may then be transferred onto winding cores. Basically, the beginning of production is to be understood as all situations in which the paper web must be "threaded" again. This occurs not only at the start-up of the paper machine, but also, e.g., after a paper web tear.

It has been observed that the insertion of the paper web in its full width into the calender, the longitudinal cutting device, and the winding device is almost impossible. Therefore, a narrow strip is initially used, which is guided from the calender to the winding device using known devices, e.g., cable guides or suction belts. However, this narrow strip is not yet wound, but is instead guided into a disposal device, e.g., a pulper. When this narrow strip has stabilized itself, it is widened until it has attained the width of the paper web, but, at least initially, even the wide paper web is still disposed of at the exit of the winding device, since the longitudinal cutting device does not become activated or begin producing partial webs until the paper web arrives in the winding device with its full width. Thus, the beginning of the partial webs can be disposed of as well. Further, only when the partial webs have stabilized are they transferred to the winding cores.

It may be advantageous for the partial webs to be cut in a crosswise manner immediately before being transferred to the winding cores. Thus, essentially same web lengths are wound onto all winding cores, and the winding sequence can begin at the same time for all paper reels.

It may be advantageous for the winding cores to be pre-accelerated to the web speed before the transfer. In this way, when the partial webs cut from the paper web come into contact with the winding core, they can be attached thereto without any large problems because there is no longer any relative speed between the partial webs and the winding cores.

Preferably, the paper reels are wound in a winding bed with one first and one second king roll, with the paper web approaching in contact with the first king roll and with the winding cores in contact during acceleration with the second king roll, which is driven, and kept at a distance from the first king roll. Thus, it becomes possible to bring the winding cores to a same circumferential speed as the first king roll by controlling the speed of the second king roll. The first king roll is also driven, with its drive being independent that of the second king roll. Thus, the two king rolls are used for different purposes. The first king roll accepts the approaching paper web and supplies it in a disposal direction, with the paper web optionally being held firmly against the first king roll with the aid of a clamping roll. The second king roll is used to accelerate the winding cores. When the partial webs have been transferred to the winding cores, the two king rolls assume their usual task again and support the paper reels being formed.

Paper reels that are wound consecutively one after the other are wound in two winding beds in an alternating fashion, with the partial webs being separated by paper reels after one batch is completed and being guided into the other winding bed, which has already been supplied with winding cores that have been pre-accelerated. Thus, it is possible to allow a continual winding of a continuous paper web onto different paper reels. The paper web can be supplied in an interruption-free manner and is constantly being wound onto the paper reels in one of the two winding beds.

It may further be advantageous for both winding beds to have one king roll in common, with the completed paper reel being lifted by this king roll and allowed to exit on the other king roll of the winding bed while the paper reels are being wound in the other winding bed. This process achieves several advantages, e.g., the progression of the paper web is essentially kept constant independently of the winding bed in which the paper reels are being wound, and the speed control of the first king roll can achieve the fact that this king roll always runs with the same circumferential speed at which the paper web approaches. Because the complete paper reels are lifted from this first king roll and are allowed to exit on the second king roll, it is also possible to use the first king roll for winding the next batch of paper reels without this being impeded by completed reels. Therefore, the spatial arrangement of the two winding beds in close proximity to one another does not constitute a reason for interrupting the winding process such that the paper web can continue to be processed at the same speed at which it exits the paper machine.

Moreover, the invention is attained in a device of the type mentioned at the outset in which the paper machine, the calender, the longitudinal cutting device, and the reel winding device are arranged in a continuous paper web travel path.

Thus, immediately after its production, the paper web can be calendered, longitudinally cut, and wound without intermediate winding steps and the corresponding stress on the paper web being necessary.

Preferably, a movable cutting device is arranged behind the calender, which is used for cutting a narrow strip from the paper web, which is to be passed through the calender in its full width. The strip can then be guided into the winding device, which the remaining part of the paper web can be disposed of. For example, it can be guided to a pulper, which reprocesses the paper web waste and supplies it to the paper machine in the form of pulp. The insertion of a narrow strip of the paper web into the winding device is far simpler than the insertion of a wide paper web.

The longitudinal cutting device preferably has knives that can be separated from one another by an opening mechanism and, in their separated state, leave open an insertion path. The separation of knives of a longitudinal cutting device is known per se. The purpose of this practice is to change the position of the longitudinal cutting knives. In the present exemplary embodiment, however, the distance to the knife is selected to be so large that the paper web can be moved through it without being damaged. Damage here is not critical in and of itself because the paper web is wound only in its cut state, so that the knives must be moved together here. However, damage to the paper web could lead to web tears, which are undesirable.

Preferably, the movable cutting device and the opening mechanism may be interlocked. Thus, it is not possible to move the knives of the longitudinal cutting device together as long as the movable cutting device has not yet cut the paper web in its full width. This prevents uncontrollable conditions from occurring in which the beginning of a partial web may not arrive correctly in the winding device.

More preferably, a disposal path is arranged behind the winding device, with a crosswise cutting device being arranged before the disposal path. As long as the paper web and/or the partial webs cut therefrom are not yet present in a form that is ready for winding, they are guided into the disposal path which can, e.g., have a pulper of the paper machine. In any case, partial webs that are ready to be wound are not present when the narrow strip is being transferred into the reel winding device. This is also true during the period of time in which the movable cutting device cuts the paper web along its width, the disposal path is needed in the winding device until the longitudinal cutting device is activated.

More preferably, the winding device has two winding beds that have one king roll in common, with an ejection device being controllable in such a way that it lifts the completed paper reels from the common king roll and allows them to exit on the other king roll. In this case, the ejection device can be constructed in a relatively simple fashion and have an ejection roll such that the completed paper reels can still rotate on the second king roll, whereupon this rotational movement is then braked. As soon as the paper reels have come to a stop, they are ejected further and then transported out of the winding device on appropriate devices, for example, a tray or a conveyor belt.

Preferably, an auxiliary device is provided in each winding bed that holds a set of winding cores to be pre-accelerated at a distance from the common king roll and against the other king roll. Thus, it is possible to accelerate winding cores in one winding bed while paper reels are being wound in the other winding bed. Here, the common king roll can rotate at the desired full speed because the winding cores are not coming into contact with it or with the material web running over it. Rather, the acceleration is caused by the second king roll.

The present invention is directed to a process for producing paper reels from a paper web. The process includes calendering the paper web, longitudinally cutting the paper web into partial webs, and winding the partial webs into paper reels. The calendering, longitudinal cutting, and winding occur on-line and without intermediate winding.

In accordance with a feature of the instant invention, the process can further include forming a narrow strip from the paper web, guiding the narrow strip into an on-line winding device, and widening the narrow strip to an entire width of the paper web. Further, after the widening of the narrow strip, the longitudinal cutting can occur on the entire width of the paper web, and the process can further include guiding the longitudinally cut partial webs onto winding cores. Further, substantially immediately before being guided onto the winding cores, the process can further include cutting the partial webs in a crosswise direction. Still further, before being guided onto the winding cores, the process can further include accelerating rotation of the winding cores to a web travel speed. Moreover, the process is performed in an apparatus that includes a first and a second king roll arranged to form a winding bed, in which at least the second king roll is driven, and the process can further include guiding the paper web over the first king roll, positioning the winding cores in contact with the second king roll and at a distance from the first king roll, whereby the acceleration of the winding cores occur, and winding the paper reels in the winding bed.

The process can be performed in an apparatus including first and second winding beds, and the process can further include winding a first batch of paper reels in the first winding bed, and winding a second batch of paper reels in the second winding bed, wherein the batches are wound alternatingly. Upon completion of one of the batches of paper reels, the process can further include accelerating rotation of the winding cores for the other batch of paper reels to a web travel speed, separating the partial webs from the completed batch of reels, and transferring the partial webs to the accelerated rotating winding cores. Further, the apparatus may include a common king roll and two other king rolls arranged to from the first and second winding bed, and, upon completion of one of the batches of paper reels, the process can further include lifting the completed paper reels off of the common king roll, and allowing the completed rolls to exit on one of the other king rolls while the other batch of paper reels are being wound in the other winding bed.

The invention is directed to an apparatus for producing paper reels that includes a paper machine, a calender, a longitudinal cutting device, and a reel winding device. The paper machine, the calender, the longitudinal cutting device, and the reel winding device are successively arranged in a web run direction.

According to a feature of the invention, the paper machine, the calender, the longitudinal cutting device, and the reel winding device can be arranged to form a continuous paper web travel path.

In accordance with another feature of the invention, the longitudinal cutting device may include a displaceable cutting device arranged behind the calender in the web run direction.

Further, the longitudinal cutting device may include knives and an opening device, which are arranged so that the opening mechanism moves the knives away from one another to form an insertion path. The displaceable cutting device and the opening mechanism can be fixedly positioned relative to one another.

Moreover, a crosswise cutting device is provided behind the winding device in the web run direction. A disposal path is formed, and the crosswise cutting device is arranged before the disposal path.

The apparatus can further include an ejection device. The winding device may include a king roll arranged to form a part of two winding beds with at least two other king rolls, and the ejection device can be arranged to controllably lift completed paper reels off the common king roll and to allow the completed paper reels to exit on one of the at least two other king rolls. An auxiliary device may be located in each winding bed to hold a set of winding cores at a distance from the common king roll for acceleration to a web travel speed.

According to still another feature of the invention, a pulper may be arranged behind the winding device.

The present invention is directed to an apparatus that includes a common king roll, first and second king rolls each arranged adjacent the common king roll to form first and second winding beds, a longitudinal cutting device arranged before the first and second winding beds in a web travel direction, and auxiliary devices arranged in each of the first and the second winding beds which are positionable to hold winding cores against one of the first and the second king roll and to maintain a distance between the winding cores and the common king roll.

According to a feature of the invention, the apparatus may be arranged to wind reels in only one winding bed at a time. Further, an ejection device may be arranged to eject completed rolls from the only one winding bed.

Moreover, as the winding of the reels in the only one winding bed nears completion, the apparatus can be arranged to accelerate empty winding cores in the other winding bed to a web travel speed via the auxiliary devices and one of the first and second king rolls.

In accordance with yet another feature of the present invention, a calender can be alternatingly coupled to the first and the second winding beds. Further, a paper manufacturing machine may be coupled to the calender. Also, a tail cutter can be positioned between the calender and the longitudinal cutter to facilitate threading of an entire width of the web. Further still, a pulper can be arranged after the first and the second winding beds in the web travel direction.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
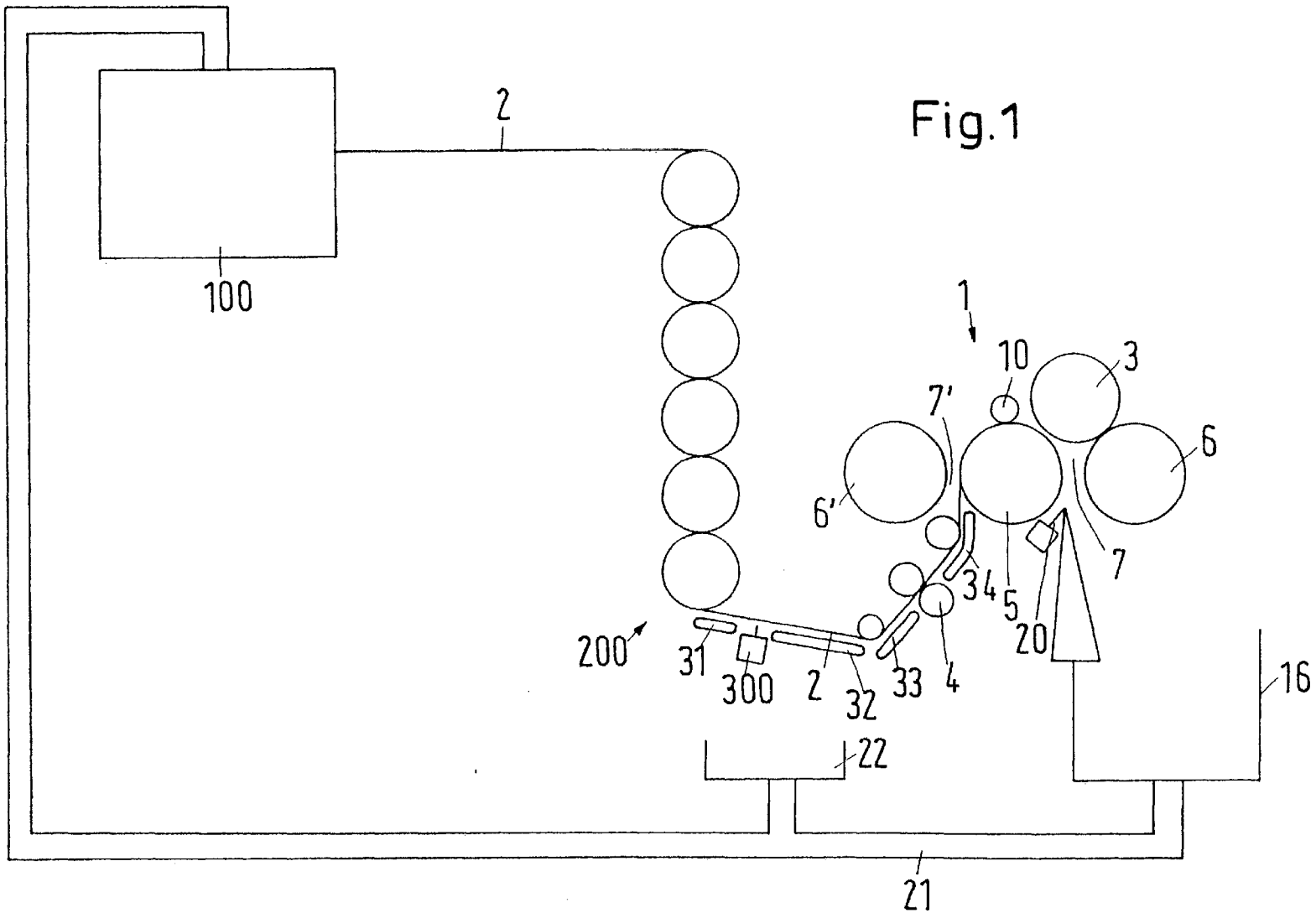
FIG. 1 schematically illustrates a device for producing paper reels in accordance with the instant invention.

FIG. 1 shows a schematic depiction of a device for producing paper reels 3 that are finally wound from a paper web 2 in a winding device 1. The paper web 2 is produced in a paper machine 100, which is shown only schematically, in a manner that is known per se and then calendered in a calender 200. Behind the calender in the web travel direction, the paper web 2 travels through a longitudinal cutting device in which it is cut into several partial webs lying parallel to one another. The partial webs are then wound into the paper reels 3. Because FIG. 1 is a schematic depiction, only the face end of the front paper reel 3 is discernible. However, several paper reels 3 behind one another in the axial direction, known as a batch, are actually being wound.

For the purpose of winding the paper reels 3, two winding beds 7, 7' are provided in the winding device 1, of which the right winding bed 7 is formed by a first king roll 5 and a second king roll 6, while the left winding bed 7' is formed by the same first king roll 5 and another second king roll 6'. The winding device 1 is shown in greater detail in FIG. 2.

A disposal device 16 is arranged behind the winding device 1. Before the disposal device 16, which can be embodied as a pulper, for example, a crosswise cutting device 20 is arranged. The crosswise cutting device 20 can be arranged behind the winding device 1 or even in the winding device 1.

The pulper is connected to the paper machine by way of a line 21 such that it is possible to return pieces of the paper web that have not been wound to the paper production.

Behind the calender 200 in the web travel direction, a cutting device 300 is arranged that may be moved crosswise to the travel direction of the paper web.

For the purpose of feeding the paper web, the paper web 2 is guided through the calender 200 in a conventional manner that is known per se, for example, in that a narrow strip is cut on the edge of the paper web and the paper is guided through the calender using guiding devices that are not shown in greater detail, such as cables or the like. Once the narrow strip has been guided through the calender, the paper web is cut to its width and then passes through the calender 200 with its full width.

In a similar manner, a narrow strip is cut from the paper web 2 with the aid of the displaceable cutting device 300 at the exit of the calender. The remainder of the paper web is guided into another disposal device 22, which can also be embodied as a pulper. This narrow strip is then guided through the longitudinal cutting device 4, whose upper and lower knives can be moved away from one another for this purpose sufficiently far that there is no danger that the paper web will come into contact with the knives, even in the case of a slightly vibrating paper web. Here, a locking mechanism is provided between the longitudinal cutting device 4, more precisely its opening mechanism, and the displaceable cutting device 300, such that the displaceable cutting device 300 can only be moved when the longitudinal cutting device 4 has been opened.

Figure 2B:
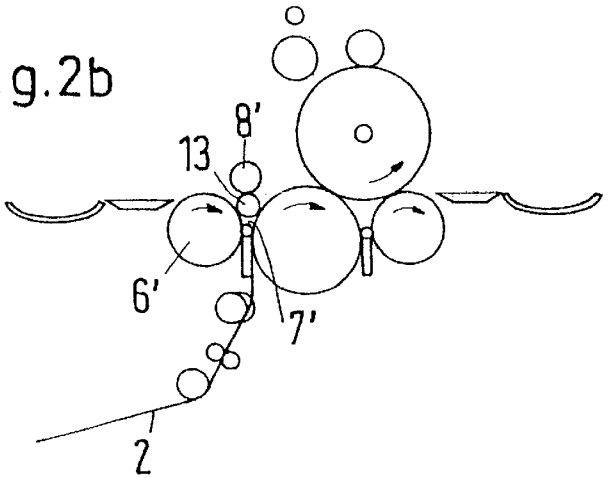
FIGS. 2*a*–2*g* schematically illustrate a reel winding device in various stages of winding.
Figure 2D:
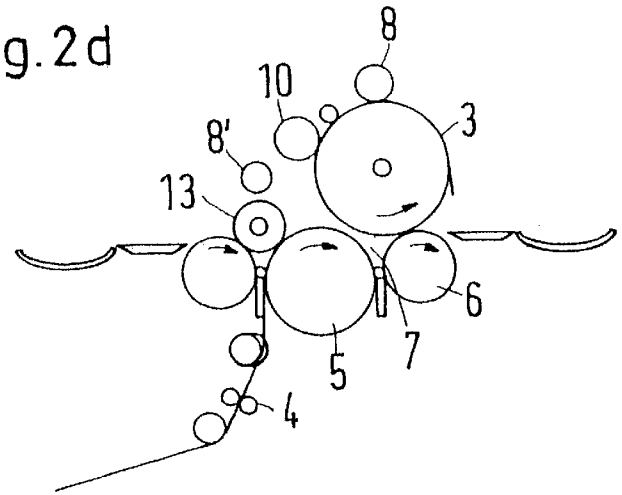
Figure 2A:
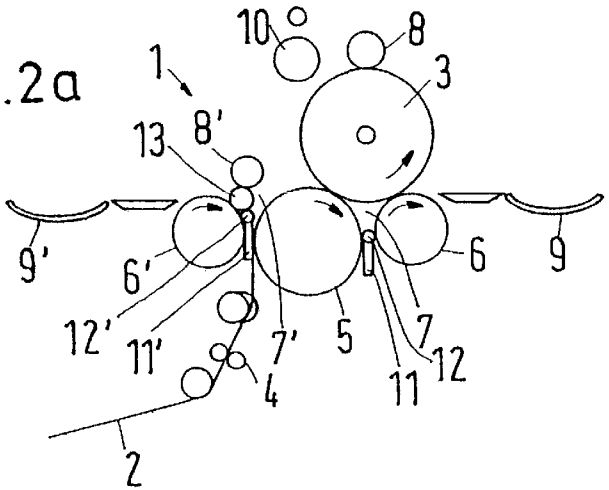
Figure 2C:
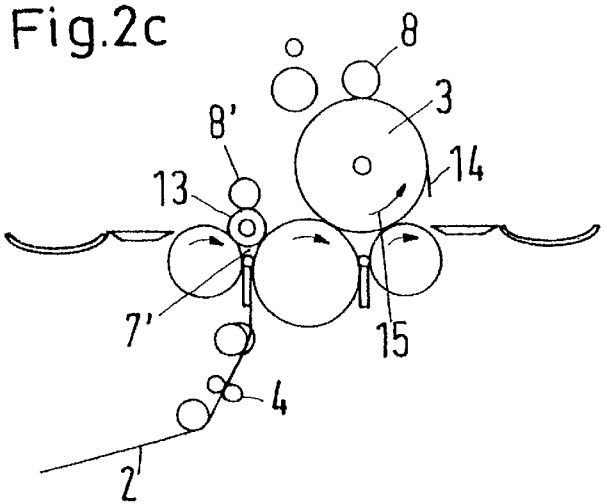
Figure 2F:
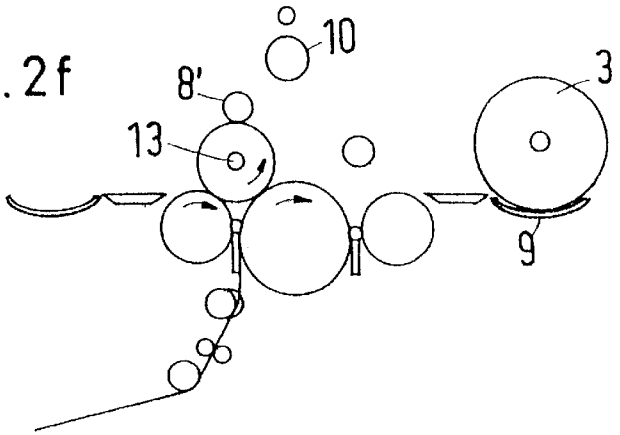
Figure 2E:
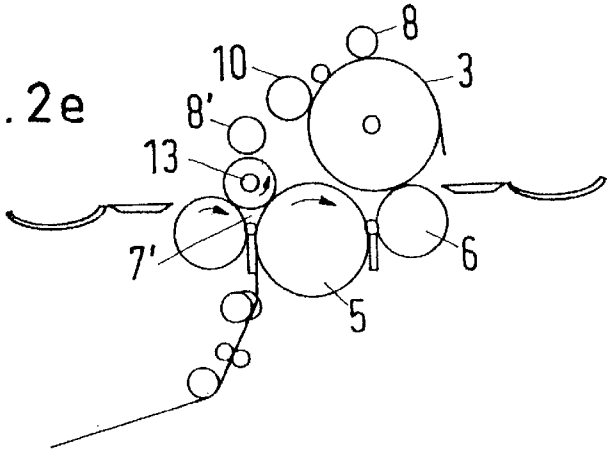
Figure 2G:
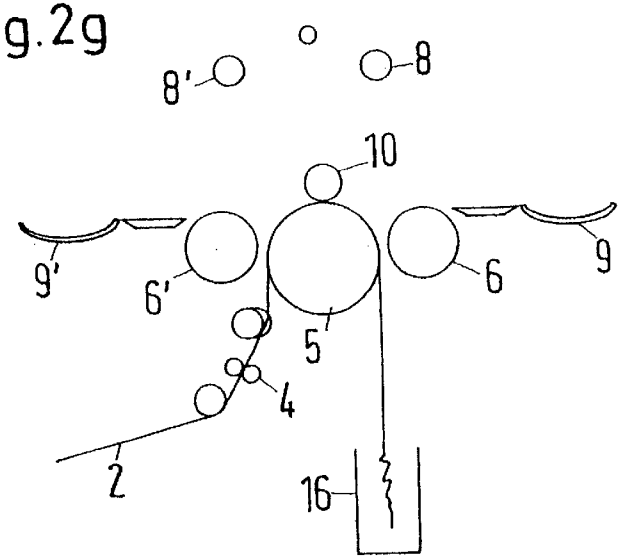

Using devices that are not shown in detail but are known per se, such as cables or other guiding devices, for example, the strip is then guided over the first king roll 5 into the winding bed 7 and from there into the disposal device 16, as can also be seen schematically in FIG. 2*g*.

Then, the displaceable cutting device 300 is moved crosswise to the travel direction of the paper web 2 such that the narrow strip increases up to the width of the paper web. In this time, the paper web is held and pulled in a clamping nip between an ejection roll 10 and the first king roll 5. All king rolls 5, 6, 6' are driven, with the drives of the two second king rolls 6, 6' being controllable independently of one another and independently of the drive of the first king roll 5.

When the paper web 2 has arrived in the winding bed 7 in its complete width, the longitudinal cutting device 4 is then activated, i.e., the knives are moved back together such that the paper web 2 is cut into partial webs. As soon as the partial webs have arrived in the winding bed 7, the crosswise cutting device 20 is activated and separates the partial webs at the same time over the entire width of the paper web. In principle, however, other separation options are also possible. At the same time or afterwards, the partial web tails are transferred onto winding cores that are already located in the winding bed 7. The batch of paper reels 3 is then wound onto these winding cores.

Guidance devices 31–34 for guiding the paper web 2 between the calender 200 and the winding device are shown schematically that can be formed by suction belts such as are produced, for example, by the company Fibron. These guidance belts are able to guide the paper web 2 reliably at higher speeds as well.

Because the paper reels 3 can only accept a limited length of the paper web 2, a so-called reel change is occasionally necessary, in which the partial webs are transferred onto new winding cores. Such a reel change is described in connection with FIG. 2. This reel change can also occur at full ejection speed of the paper machine 100.

FIG. 2 shows the winding device 1 for winding the paper web 2 into a so-called batch of paper web reels 3 that results in that the paper web 2 passes through the longitudinal cutting device 4, in which it is cut into several partial webs. The arrows in the rolls and reels show which parts are rotating.

FIG. 2*a* shows a state in which the paper web reels 3 have been wound almost completely. The paper web reels 3 lie in the first winding bed 7.

For each winding bed 7, 7', a loading roll 8, 8' is provided, with all the rolls being arranged in a machine frame, which is not shown in greater detail. Troughs 9, 9' are provided on the outer side of each of the two second king rolls 6, 6' for the purpose of accepting a finished batch of paper web reels 3.

Above the first king roll 5, an ejection roll 10 is positioned that is described farther below.

An auxiliary device 11, 11' with a support roll 12, 12' is arranged in each winding bed 7, 7'. As can be seen by comparing FIG. 2*a* with FIG. 2*b*, the support roll 12, 12' can be moved vertically upwards and downwards in the winding bed 7, 7'. If, as is shown in the left half of FIG. 2*a*, it has been moved upwards, it holds the winding cores 13 such that the winding cores 13 rest against the second king roll 6' but maintain a distance from the first king roll 5.

Once the paper web reels 3 have been almost completely wound, winding cores 13 are supplied to the other winding bed 7' in a conventional manner. Here, the first king roll 5 and the second king roll 6 of the winding bed 7 continue to rotate at their normal speed such that the paper web reels 3 also continue to be wound. In this phase, the loading roll 8 serves only to prevent the paper web reels 3 from jumping out of the winding bed 7.

The winding cores 13 in the other winding bed 7 are pre-accelerated in that the second king roll 6' of this winding bed 7' is displaced in rotation. The loading roll 8' of this winding bed 7' is lowered and clamps the winding cores in place with the second king roll 6' and the support roll 12'. Optionally, the loading roll 8' can be driven as well.

When the winding cores 13 have the same circumferential speed as the first king roll 5, they are lowered into the winding bed 7' in that the support roll 12' is lowered. The winding cores 13 then come into contact with the approaching paper web 2 and the second king roll 6' of the second winding bed 7'. This situation is shown in FIG. 2*b*. The loading roll 8' presses the winding cores 13 into the winding bed 7'. The winding cores 13 and the paper web 2 have the same speed.

As soon as this state has been reached, the paper web 2 is separated in the crosswise direction and transferred onto the winding cores 13. In order to clarify this, the front paper web reel 3 is shown with a web tail 14. In reality, however, the paper web reels 3 continue to rotate in the direction of the arrow 15 while the winding of new paper web reels on the winding cores 13 is continued in the winding bed 7'.

Immediately after the transfer of the paper web 2 onto the winding cores 13 or even some time later, when the new winding reels have already acquired a greater diameter, as can be seen in FIG. 2*d*, the ejection roll 10 is lowered and, with reference to the arrangements in FIG. 2*d*, displaced far enough to the right that the batch of paper web reels 3 has been lifted off of the first king roll 5 and only rests on the second king roll 6 of the first winding bed 7. Here, the axes of the second king roll 6, the loading roll 8, and the ejection roll 10 form a triangle in which the axis of the paper web reels 3 is located. The paper web reels 3 are thus gripped between three rolls 6, 8, 10 and can thus be held in their position on the second king roll 6 in a relatively stable manner. Optionally, the loading roll 8 is also displaced a short distance to the right for this purpose.

At this point, it should be mentioned that the first king roll 5 and both second king rolls 6, 6' each have a drive of their own, with the drives of the second king rolls 6, 6' being able to act as a brake and with the drives being controllable independently of one another.

As soon as the paper reels 3 have been lifted off of the first king roll 5, the second king roll 6 is braked. If it, and therefore the individual reel batch of the paper web reels 3, has come to a standstill, the batch is ejected in a known manner. It arrives in the deposit trough 9 and, from there, is removed axially from the winding device 1 by means of a transport belt that is not shown in detail here.

When the paper web reels forming on the winding cores 13 have reached their target diameter, the same transfer sequence occurs into the other winding bed 7', but in its mirror image.

In FIGS. 2*a*–2*f*, the structure of the sequences if individual reels with consistent dimensions are to be produced continuously has been sketched. FIG. 2*g* shows in addition how it is possible to proceed for the purpose of changing a format, i.e., the width of the partial webs cut from the paper web 2 with the aid of the longitudinal cutting device 4.

In this case, the paper web 2 is separated in a crosswise fashion in a known manner. The ejection roll 10 now serves an additional function. It is lowered onto the first king roll 5 and then forms a clamping nip with the first king roll 5 through which the approaching paper web continues to be fed. However, the paper web does not continue to be wound, but rather arrives in the disposal device 16, for example, the pulper of a paper factory, by way of the winding bed 7. As the paper web 2 continues to travel, the upper and lower knives of the longitudinal cutting device 4 are moved to a distance from one another, the longitudinal cutting is therefore interrupted so that the upper and lower knives may be repositioned in a manner that is known per se. Once this has occurred, the cutting process is initiated again. As soon as the resulting individual webs have passed through the nip between the ejection roll 10 and the first king roll 5, they are removed across the width of the paper web 2 and the new web tails are wound onto corresponding empty cores 13.

In order to insert the winding cores into the winding beds 7, 7', it may be useful to string the winding cores onto winding rods or to fix them axially in another manner. In principle, however, it is possible to place the empty winding cores 13 in the winding beds 7, 7' on skids or guiding surfaces.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for producing paper reels from a paper web comprising:

calendering the paper web;

forming a narrow strip from the calendered paper web;

guiding the narrow strip to a winding device and into a disposal device;

widening the narrow strip to an entire width of the paper web;

longitudinally cutting the entire width paper web into partial webs; and winding the partial webs into paper reels, wherein the calendering, longitudinal cutting, and winding are consecutively performed without intermediate winding.

2. The process in accordance with claim 1, further comprising guiding the paper web, without intermediate winding, from a paper web making machine to a calender.

3. The process in accordance with claim 1, wherein, after the widening of the narrow strip, the process further comprises:

guiding the longitudinally cut partial webs onto winding cores.

4. The process in accordance with claim 3, wherein, substantially immediately before being guided onto the winding cores, the process further comprises cutting the partial webs in a crosswise direction.

5. The process in accordance with claim 3, wherein before being guided onto the winding cores, the process further comprises accelerating rotation of the winding cores to a web travel speed.

6. The process in accordance with claim 5, wherein said process is performed in an apparatus that includes a first and a second king roll arranged to form a winding bed, in which at least the second king roll is driven, and said process further comprises:

guiding the paper web over the first king roll;

positioning the empty winding cores in contact with the second king roll and at a distance from the first king roll, whereby the acceleration of the empty winding cores occur; and winding the paper reels in the winding bed.

7. The process in accordance with claim 1, wherein said process is performed in an apparatus including first and second winding beds, and said process further comprises:

winding a first batch of paper reels in the first winding bed;

winding a second batch of paper reels in the second winding bed, wherein the batches are wound alternatingly.

8. The process in accordance with claim 7, wherein, upon completion of one of the batches of paper reels, the process further comprises:

accelerating rotation of the winding cores for the other batch of paper reels to a web travel speed;

separating the partial webs from the completed batch of reels; and transferring the partial webs to the accelerated rotating winding cores.

9. The process in accordance with claim 7, wherein the apparatus includes a common king roll and two other king rolls arranged to from the first and second winding bed, and, upon completion of one of the batches of paper reels, the process further comprises:

lifting the completed paper reels off of the common king roll; and allowing the completed rolls to exit on one of the other king rolls while the other batch of paper reels are being wound in the other winding bed.

10. An apparatus for producing paper reels comprising:

a paper machine;

a calender;

a longitudinal cutting device;

a reel winding device;

a disposal device arranged downstream of said reel winding device, relative to a web run direction, wherein said paper machine, said calender, said longitudinal cuffing device, and said reel winding device are successively arranged in the web run direction to form a continuous paper web travel path between said paper machine and said reel winding device.

11. The apparatus in accordance with claim 10, further comprising a displaceable cuffing device arranged behind said calender in said web run direction.

12. The apparatus in accordance with claim 10, wherein said longitudinal cutting device comprises knives and an opening device, which are arranged so that the opening mechanism moves the knives away from one another to form an insertion path.

13. The apparatus in accordance with claim 12, wherein said displaceable cutting device and said opening mechanism are structure to not operate at the same time.

14. The apparatus in accordance with claim 10, further comprising a crosswise cutting device, wherein, behind said winding device in the web run direction, a disposal path is formed, and said crosswise cutting device is arranged before the disposal path.

15. The apparatus in accordance with claim 10, further comprising an ejection device, wherein the winding device comprises a king roll arranged to form a part of two winding beds with at least two other king rolls, and said ejection device is arranged to controllably lift completed paper reels off said common king roll and to allow the completed paper reels to exit on one of the at least two other king rolls.

16. The apparatus in accordance with claim 15, further comprising an auxiliary device located in each winding bed to hold a set of empty winding cores at a distance from said common king roll for acceleration to a web travel speed.

17. The apparatus in accordance with claim 10, wherein said disposal device comprises a pulper.

18. An apparatus comprising:

a common king roll;

first and second king rolls each arranged adjacent said common king roll to form first and second winding beds;

a longitudinal cutting device arranged before said first and second winding beds in a web travel direction; and auxiliary devices arranged in each of said first and said second winding beds which are positionable to hold empty winding cores against one of said first and said second king roll and to maintain a distance between the empty winding cores and said common king roll.

19. The apparatus in accordance with claim 18, wherein said apparatus is arranged to wind reels in only one winding bed at a time.

20. The apparatus in accordance with claim 19, further comprising an ejection device arranged to eject completed rolls from said only one winding bed.

21. The apparatus in accordance with claim 18, wherein, as the winding of the reels in the only one winding bed nears completion, said apparatus is arranged to accelerate empty winding cores in the other winding bed to a web travel speed via the auxiliary devices and one of the first and second king rolls.

22. The apparatus in accordance with claim 18, further comprising a calender alternatingly coupled to said first and said second winding beds.

23. The apparatus in accordance with claim 22, further comprising a paper manufacturing machine coupled to said calender.

24. The apparatus in accordance with claim 23, further comprising a tail cutter positioned between said calender and said longitudinal cutter to facilitate threading of an entire width of the web.

25. The apparatus in accordance with claim 24, further comprising a pulper arranged after said first and said second winding beds in the web travel direction.

26. The apparatus in accordance with claim 18, wherein said auxiliary devices are positioned between said common king roll and said first and second king rolls in order to maintain the distance of the empty winding core from the common king roll while holding the empty core against one of the first and second king rolls.

* * * * *